US005361738A

United States Patent [19]

Iida

[11] Patent Number: 5,361,738

[45] Date of Patent: Nov. 8, 1994

[54] DECOMPRESSION DEVICE FOR AN ENGINE

[75] Inventor: Yoshikazu Iida, Tokyo, Japan

[73] Assignee: Kioritz Corporation, Tokyo, Japan

[21] Appl. No.: 50,615

[22] Filed: Apr. 22, 1993

[30] Foreign Application Priority Data

May 18, 1992 [JP] Japan ..... 4-032562[U]

[51] Int. Cl.[5] ..... F02B 77/08

[52] U.S. Cl. ..... 123/182.1; 123/185.4

[58] Field of Search ..... 123/182.1, 185.3, 185.4

[56] References Cited

U.S. PATENT DOCUMENTS

| | | | |
|---|---|---|---|
| 2,742,380 | 4/1956 | Peters . | |
| 2,947,300 | 8/1960 | Trapp . | |
| 3,361,124 | 1/1968 | Fend . | |
| 3,687,124 | 8/1972 | Kolorz | 123/182.1 |
| 4,257,367 | 3/1981 | Fujikawa et al. | 123/185.4 |
| 5,116,287 | 5/1992 | Hironaka et al. | 123/182.1 |
| 5,211,140 | 5/1993 | Hironaka et al. | 123/182.1 |

FOREIGN PATENT DOCUMENTS 61-38162 2/1986 Japan .

*Primary Examiner*—Tony M. Argenbright
*Assistant Examiner*—M. Macy
*Attorney, Agent, or Firm*—Finnegan, Henderson, Farabow, Garrett & Dunner

[57] ABSTRACT

There is provided a highly reliable decompression device of engine which is constructed relatively simply without forming an opening responsible for intrusion of dusts and dirts or foreign matter into a starter cover and/or clogging of foreign matter to ensure that defective operation of individual components due to dusts and dirts hardly occurs to permit steady decompression inside a combustion chamber in cooperation with cranking operation effected by a recoil starter. The decompression device is provided in an internal combustion engine with a recoil starter having a starter cover, a recoil drum housed in the starter cover, and a rotation transmission member movable in the axial direction in cooperation with rotation of the recoil drum to transmit torque from the recoil drum to a crank shaft of the engine. The decompression device comprises a decompression passage through which a combustion chamber defined by the inner wall surface of a cylinder and the top surface of a piston communicates with the outside, a decompression valve inserted in the decompression passage, and valve operating device bearing on a bearing provided in the starter cover and rotated as the rotation transmission member moves in the axial direction to operate the decompression valve.

2 Claims, 5 Drawing Sheets

DECOMPRESSION DEVICE FOR AN ENGINE

BACKGROUND OF THE INVENTION

1. Field of the Invention

The present invention relates to a decompression device provided for facilitating start-up of an internal combustion engine such as an air-cooled two-cycle gasoline engine and the like, and more particularly to a decompression device which provided in a relatively small-sized and light engine with a recoil starter suitable for use as a power source incorporated in such a work machine as a portable or conveyable sprayer or bush cutter and which is operative to reduce pressure in the combustion chamber in cooperation with cranking operation effected by the recoil starter.

2. Description of the Prior Art

Generally, in the work machine such as a portable or conveyable sprayer or bush cutter, an air-cooled two-cycle gasoline engine with a recoil starter which is relatively easy to reduce in size and weight is used frequently as a power source of the work machine.

It has hitherto been well known as described in, for example, Japanese Patent Application Laid-open No. Sho 61-38162 or Japanese Utility Model Application Laid-open No. Hei 3-95078 to additionally provide a decompression device which reduces pressure in a combustion chamber of the engine in cooperation with cranking operation effected by the recoil starter in order to facilitate start-up of the engine with the recoil starter.

The additional provision of the decompression device is fulfilled frequently not only in the engine with recoil starter but also in an engine with self starter, with a view of reducing size and weight as well as power consumption of a motor serving as a power source of the self starter.

Essentially, this type of decompression device is comprised of a decompression passage through which a combustion chamber defined by the inner wall surface of a cylinder and the top surface of a piston in an engine body communicates with an external component such as, for example, an intake passage, an exhaust passage or scavenging port, a decompression valve inserted in the decompression passage, and valve operating means for opening the decompression valve upon start-up operation (cranking period).

In the decompression device provided in the engine with a recoil starter, the valve operating means is designed to open the decompression valve in cooperation with cranking operation effected by the recoil starter. More specifically, as disclosed in the aforementioned literatures, the recoil starter is provided with a rotation transmission member which, when a recoil drum is rotated by pulling out rushingly the fore end of a recoil rope wound about the recoil drum in a starter cover, is moved in the axial direction in cooperation with the rotation of the recoil drum to engage with a crank shaft so as to transmit torque of the recoil drum to the crank shaft under the engaged condition, whereby a decompression operating rod or the like constituting the valve operating means is laterally moved by utilizing the axial moving motion of the rotation transmission member to rotate or push a spool or the like of the decompression valve so as to open the same, thereby causing the combustion chamber to communicate with the external component through the decompression passage.

When the combustion chamber and the external component are brought into communication with each other, a part of air-fuel mixture in the combustion chamber is admitted to the outside through the decompression passage to reduce pressure acting on the top surface of the piston, thereby ensuring that torque required to rotate the crank shaft can be reduced and pay-out of the recoil rope can be facilitated to make start-up of the engine easy.

In the recoil starter called the Bendix type as shown in the aforementioned two literatures, the rotation transmission member is rotated by torque applied to the recoil drum while the rotation transmission member being coaxially fitted in the recoil drum through spiral spline teeth to enable the rotative motion of the recoil drum to be utilized to axially move the rotation transmission member; and besides braking force is applied to oppose the rotation of the rotation transmission member in order to regulate co-rotation of the rotation transmission member along with the recoil drum, wherein a friction braking member (friction spring) for application of the braking force is used as the decompression operating rod or the like constituting the valve operating means.

In the prior art decompression device provided in the engine with the recoil starter as described previously, since as the rotation transmission member moves in the axial direction, the decompression operating rod or the like constituting the valve operating means is also moved in the same direction to operate the decompression valve, there is a need for the starter cover to be necessarily formed with an opening (window) having a certain width which allows the movement of the decompression operating rod or the like.

With the opening formed in the starter cover in this manner, external dusts and dirts will intrude into the starter cover through that opening. Inside the starter cover, sliding parts such as the recoil drum and rotation transmission member are arranged and when dusts and dirts intrude into these parts, operation of the sliding parts is caused to be defective and the defective operation of the recoil starter will induce defective operation of the decompression device cooperative with the recoil starter.

Especially, in the case where the conventional recoil starter and decompression device are additionally provided to the air-cooled engine frequently used for a work machine such as a sprayer or bush cutter, ambient air for cooling blows around the recoil starter or is drawn therein, with the result that foreign matter such as powder materials and pest control liquid or cut grasses mixed in the ambient air intrudes into the recoil starter through the opening or clogs therein and possibly, proper operation of the recoil starter and decompression device will be prevented.

The above defective operation of the recoil starter and decompression device invites significant problems that the engine faces difficulties in starting, the decompression valve is not closed completely to cause a decrease in engine output and the engine is forcibly started resulting in breakdown of the recoil starter and decompression device.

It will be envisaged that when dusts and dirts or foreign matter intrudes into the starter cover, they maybe removed; however it is very difficult to remove dusts and dirts in the starter cover externally thereof and there results a need of dismounting the starter cover and disassembling the recoil starter, requiring time-consuming and troublesome disassembling and assembling works, so that in effect the starter cover is frequently disregarded with dusts and dirts contained therein.

Further, the prior art decompression device is such that the decompression operating rod or the like constituting the valve operating means also serves as the friction braking member (friction spring) of the aforementioned recoil starter and is made of a spring material having certain resiliency, and therefore, in addition to the aforementioned problem of intrusion of dusts and dirts, inconvenience is liable to occur wherein when operating the decompression valve, the decompression operating rod tends to be flexed and bent by repulsive force exerting from the decompression valve and so the amount of opening of the decompression valve becomes deficient, leading to a failure to sufficiently reduce pressure inside the combustion chamber.

SUMMARY OF THE INVENTION

The present invention contemplates elimination of the above conventional drawbacks and it is an object of the invention to provide a highly reliable decompression device of engine which is constructed relatively simply without forming an opening responsible for intrusion of dusts and dirts or foreign matter into the starter cover or clogging of foreign matter to ensure that defective operation of individual components due to dusts and dirts hardly occurs to permit steady decompression inside the combustion chamber in cooperation with cranking operation effected by the recoil starter.

To accomlish the above object, in a decompression device of engine according to the invention, valve operating means bears on a portion of a starter cover and is rotated in cooperation with cranking operation effected by a recoil starter.

Specifically, the decompression device according to the present invention is provided in an engine with a recoil starter having a starter cover, a recoil drum housed in the starter cover and a rotation transmission member movable in the axial direction in cooperation with rotation of the recoil drum to transmit torque from the recoil drum to a crank shaft.

The decompression device essentially comprises a decompression passage through which a combustion chamber defined by the inner wall surface of a cylinder and the top surface of a piston in an engine body communicates with the outside, a decompression valve inserted in the decompression passage and valve operating means for operating open/close of the decompression valve, wherein the valve operating means bears on a bearing provided in the starter cover and is rotated within a predetermined rotation angle range in cooperation with axial movement of the rotation transmission member to operate open/close of the decompression valve in accordance with the direction of movement of the rotation transmission member.

In the decompression device of engine according to the present invention, a preferred form of the valve operating means includes two constituent members of which one is an engaging rotary member bent to take the form of a crank and having its root engaging the rotation transmission member and its outer end bearing on the bearing provided in the starter cover and the other is a rotary push member fitted on the outer end of the engaging rotary member and rotatable along with the engaging rotary member to push an operating end of the decompression valve.

In the decompression device of engine according to the present invention constructed as above, when cranking operation is carried out by the recoil starter, the valve operating means is rotated in cooperation with axial movement of the rotation transmission member arranged in the starter cover by a predetermined rotation angle corresponding to a moving distance of the rotation transmission member and its operating end pushes, for example, a spool of the decompression valve to open the decompression valve.

At that time, the rotation transmission member engages a crank shaft of the engine through, for example, a dog clutch to transmit torque of the recoil drum to the crank shaft.

In this phase, since the decompression valve is opened by the valve operating means, the air-fuel mixture inside the combustion chamber is admitted to the outside through the decompression passage and pressure acting on the top surface of the piston is reduced. As a result, torque required to rotate the crank shaft is reduced to ensure that the engine can be started easily without applying appreciably large operating force to the recoil starter.

In the decompression device of engine of the invention, since the valve operating means is constructed such that it bears on a portion of the starter cover and is rotated by utilizing the axial movement of the rotation transmission member of the recoil starter, it suffices that an insertion hole for bearing is formed in the starter cover and the valve opeating means is passed through the insertion hole, thereby making it unnecessary to form a large opening as in the prior art which permits lateral movement of the valve operating means. In this case, the insertion hole for bearing formed in the starter cover is sealed airtightly when the valve operating means bears on the insertion hole.

As a consequence, intrusion of foreign matter such as dusts and dirts or powder materials, pest control liquid or cut grasses into the starter cover and its clogging in the opening can be prevented steadily to effectively avoid such a trouble that operation of rotary parts such as the recoil drum and the rotation transmission member arranged in the starter cover or operation of the valve operating means becomes defective.

In addition, since the valve operating means can be constructed separately from the friction braking member of the recoil starter and the decompression valve can be operated by rotary motion of the valve operating means, flection and bending of the valve operating means upon operation of the decompression valve hardly occur, so that with the relatively simplified construction, defective operation is made to hardly occur to improve reliability of the device.

DESCRIPTION OF THE PREFERRED EMBODIMENTS

Embodiments of the present invention will now be described in detail with reference to the accompanying drawings.

Figure 1:
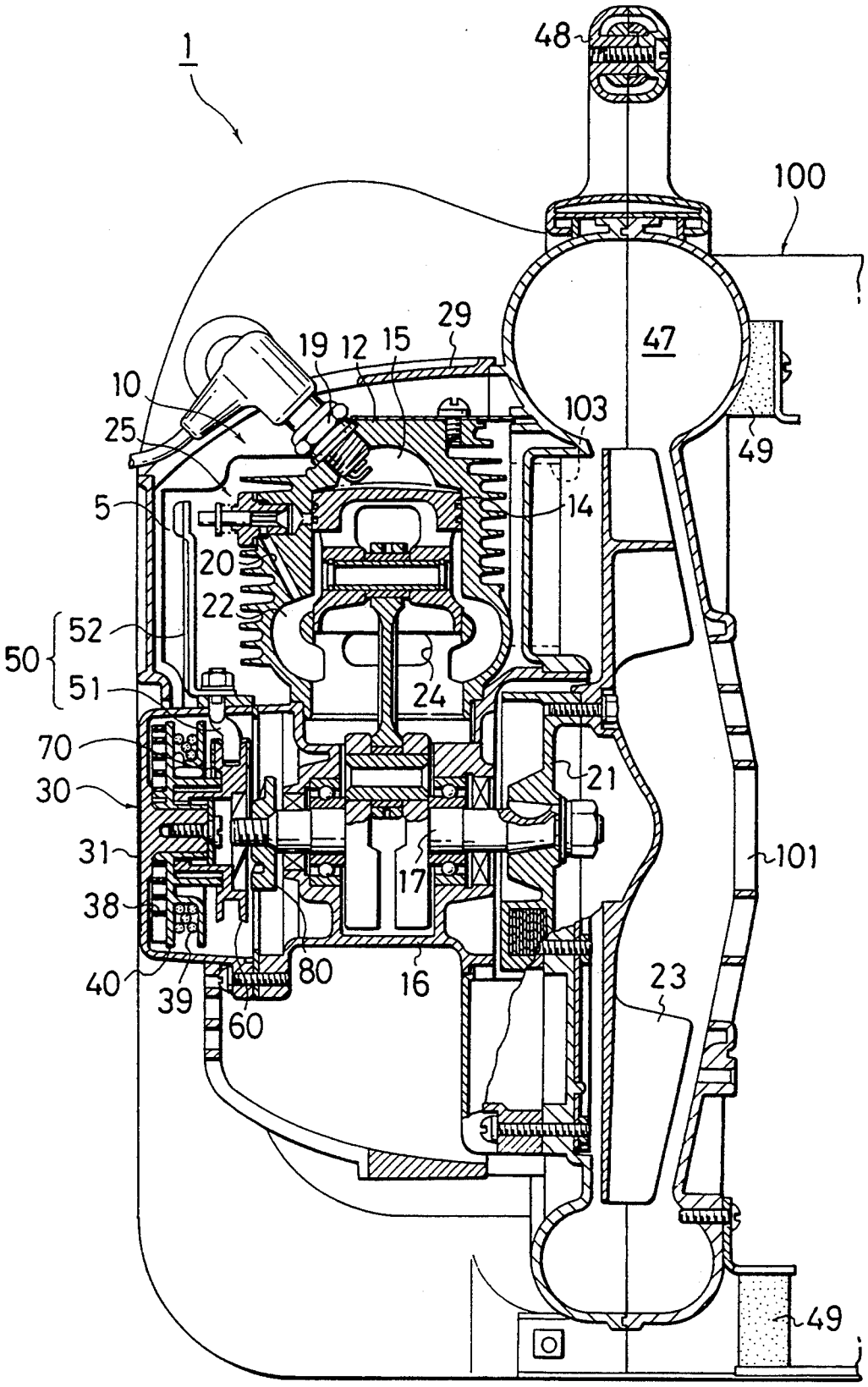
FIG. 1 is a longitudinal sectional view showing a state in which an air-cooled 2-cycle engine with a recoil drum applied with an embodiment of a decompression device according to the invention is incorporated, as a power source, in a backpack type power blower.

FIG. 1 shows a state in which an air-cooled 2-cycle gasoline engine with a recoil drum applied with an embodiment of a decompression device according to the present invention is incorporated, as a power source, in a backpack type power blower 1 used for cleaning and the like work.

Construction of Engine and its Peripheral Components

FIG. 1

Referring to FIG. 1, the blower 1 has, as a main component, an engine body 10 comprising a cylinder 12 provided with a plurality of cooling fins and a crank case 16 attached to the bottom of the cylinder 12, a piston 14 is inserted in the cylinder 12, a combustion chamber 15 is defined by an inner wall surface of the cylinder 12 and a top surface of the piston 14, and an ignition plug 19 screwed into the combustion chamber 15.

In compliance with a known form, an intake port 24, scavenging ports 22 and an exhaust port (not appearing in the figure) are opened to the cylinder 12 and air-fuel mixture from a carburetor not shown is admitted, through the intake port 24, to the interior of the crank case 16 underlying the cylinder 12, so that respective strokes of 2-cycle engine are carried out sequentially in accordance with ascent and descent of the piston 14.

On the other hand, a crank shaft 17 bears on the crank case 16 with its opposite ends projecting beyond the crank case 16. Mounted to one end of the crank shaft 17 is a flywheel 21 also serving as a magnet rotor of an ignition unit, and fixed to this flywheel 21 is a blast fan 23 also serving as an engine cooling fan. A cover 29 mounted to the outer periphery of the engine body 10 covers the same and the blast fan 23 is formed, at its outer circumference, with a spiral casing 47 whose diameter increases gradually toward a blow-off port not shown.

The engine body 10 is supported on a backpack frame 100 through vibration damping rubbers 49 and in the illustrated state, the power blower 1 can be used as an air scavenger in which during operation of the engine, ambient air is sucked through a suction port 101 by means of the blast fan 23 and blown off to the outside through the spiral casing 47 and a jet pipe connected to the blow-off port; and alternatively, when a powder material tank is attached to in the place of, for example, a carry handle 48 provided above the spiral casing 47, the power blower 1 can also be used as a power duster in which ambient air passing through the spiral casing 47 is mixed with powder chemicals in the powder material tank and blown off through the jet pipe connected to the blow-off port.

The cover 29 is formed, at its portion extending between the cylinder 12 and the blast fan 23, with a cooling opening 103 so that ambient air passing therethrough may be used to cool the engine.

On the opposite side to the blast fan 23, the engine body 10 is provided with a recoil starter 30 and an embodiment of a decompression device 5 according to the present invention. Since the decompression device, 5, of the present embodiment is arranged in association with the recoil starter 30, the construction of the recoil starter 30 will first be described.

Construction of Recoil Starter

Figure 2:
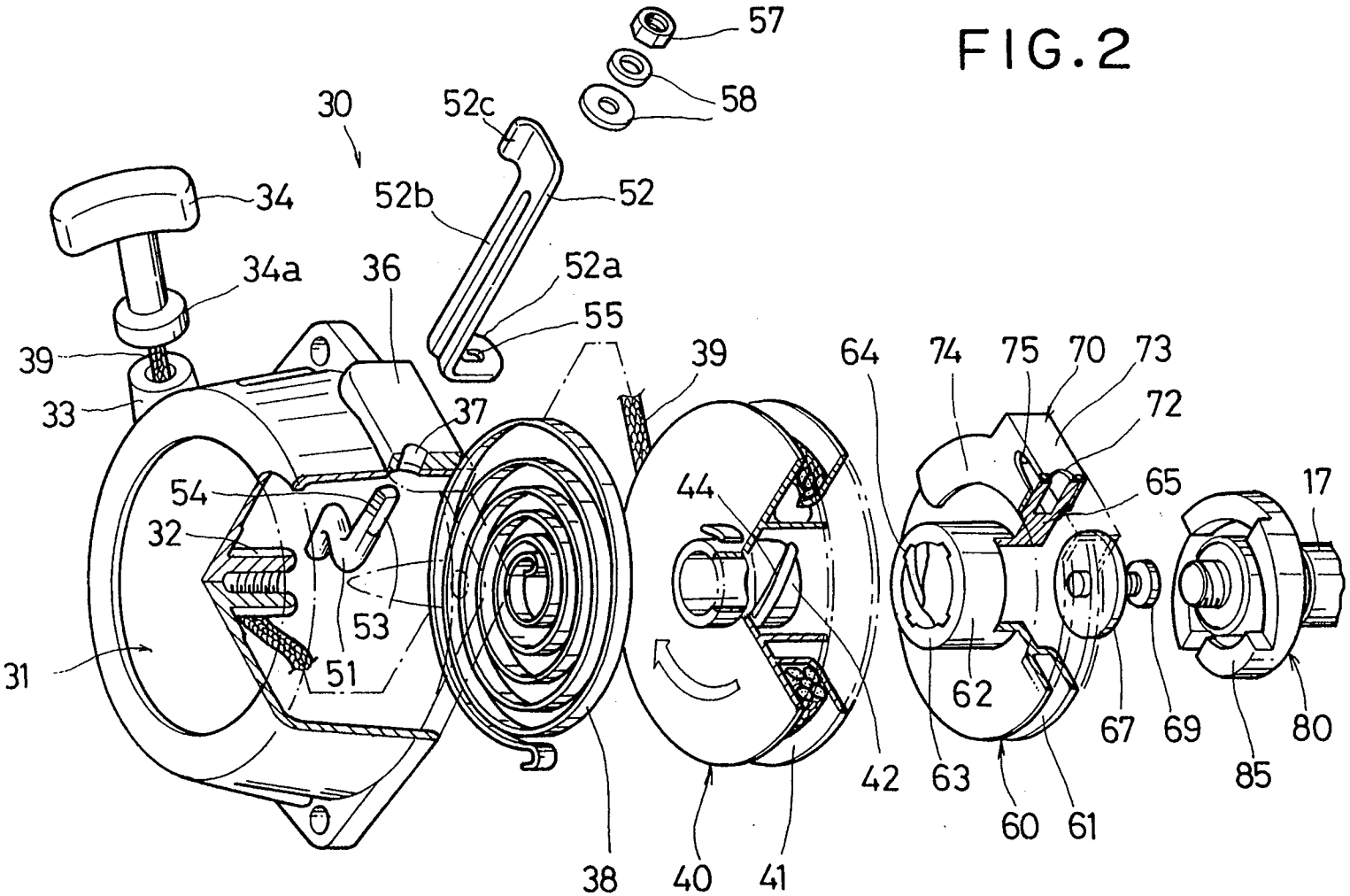
FIG. 2 is an exploded perspective view showing the main part of the embodiment.
Figure 3:
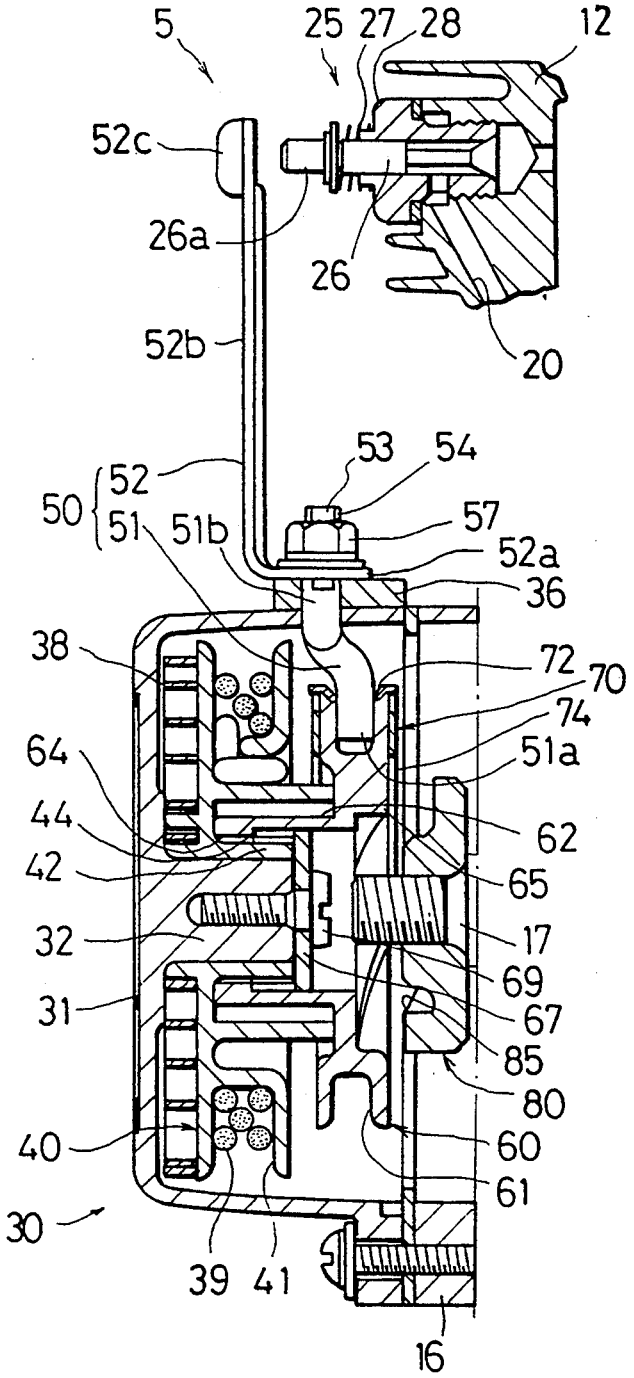
FIG. 3 is an enlarged longitudinal sectional view showing the main part of the embodiment.

FIGS. 2 and 3

As detailed in an exploded view of FIG. 2, the recoil starter 30 includes a starter cover 31 mounted to the engine body 10, a spiral spring 38, a recoil drum 40, a rotation transmission member 60, a friction braking member 70, a retainer 67 and a follower pawl member 80 screwed on and fixed to the crank shaft 17.

The starter cover 31 has a bottomed cylindrical form and it is so positioned that its center axis aligns with the rotation axis of the crank shaft 17 and is mounted airtightly to the crank case 16 by means of, for example, bolts. The starter cover 31 has a pay-out port 33 through which a fore end portion of a recoil rope 39 wound on a circumferential groove 41 of the recoil drum 40 is payed out, and a stopper 34*a* of a handle 34 mounted to the fore end of the recoil rope 39 is airtightly fitted on the pay-out port 33. Secured to an upper surface of the starter cover 31 is a bearing plate 36 on which valve operating means 50 to be described later bears, and formed in the bearing plate 36 and starter cover 31 is an insertion hole 37 which passes therethrough.

A shaft boss 32 threaded with a female screw extends from a central portion of the starter cover 31 and the spiral spring 38 is fitted around the shaft boss 32 while a boss 42 integral with the recoil drum 40 being rotatably fitted on the shaft boss The inner end of the spiral spring 38 is hooked on the recoil drum 40 with its outer end hooked on the starter cover 31, whereby the recoil drum 40 is normally urged or biased by the spiral spring in a direction in which the recoil rope 39 is rolled up.

On the other hand, left-handed male spiral spline teeth 44 of a plurality of threads are formed on an outer peripheral surface portion of the boss 42, close to the rotation transmission member 60, of the recoil drum 40 and female spiral spline teeth 64, also of a plurality of threads, which mesh the male spiral spline teeth 44 are threaded on a thick portion 63 formed on an end, close to the recoil drum 40, of a boss 62 projecting from a central portion of the rotation transmission member 60. The rotation transmission member 60 is provided, at its side remote from the recoil drum 40, with drive pawls 65 and besides it is formed, at its outer circumference, with a circumferential groove 61 in which a root 51*a* of a valve operating means 50 to be described later is loosely fitted.

The retainer 67 is mounted to the end surface of the shaft boss 32 of the aforementioned starter cover 31 by means of a screw 69. This retainer 67 plays the role of preventing the recoil drum 40 and rotation transmission member 60 from dropping off.

The friction braking member 70 overlies the upper half of the rotation transmission member 60. The friction braking member 70 is comprised of an inverted U-shaped engaging part 73 having its top formed with an engaging hole 72 in which the root 51*a* of the valve operating means 50 to be described later is inserted, and a pair of semi-annular clamping friction plate parts 74 which are integrally contiguous to both sides of the inverted U-shaped engaging part 73 and which press lightly resiliently outer peripheral edges on both sides of the rotation transmission member 60. In order to make easy adjustment of friction braking force applied from the clamping friction plate parts 74 to the rotation transmission member 60, an elongated hole 75 is formed between the inverted U-shaped engaging part 73 and each of the clamping friction plate parts 74.

The drive pawls 65 of the rotation transmission member 60 mesh follower pawls 85 formed on the follower pawl member 80 meshing the crank shaft 17 through right-handed screw in order to transmit only unidirectional (clockwise) rotation torque from the rotation transmission member 60 to the crank shaft 17.

Construction of Decompression Device

FIGS. 1, 2, 3 and 5

The decompression device 5 of the present embodiment arranged in association with the aforementioned recoil starter 30 includes a decompression passage 20 through which the combustion chamber 15 communicates with the outside, a normally-closed decompression valve 25 inserted in the decompression passage 20 and the valve operating means 50 for performing switching operation of the decompression valve 25.

The decompression passage 20 has a substantially horizontal start end which opens to an inner wall portion of cylinder 12 positioned slightly below the top dead center of the piston 15 (at a position shown in FIG. 1), an intermediate slant portion and a terminational end which opens to the scavenging port 22, whereby in a compression stroke in which the piston ascends, the air-fuel mixture prevailing in the combustion chamber 15 can be relieved to the crank case 16 (crank chamber) during an interval of time that the top of the piston 14 passes by the upper end of the scavenging port 22 and thereafter passes by the start end of the decompression passage 20.

The decompression valve 25 is so mounted as to block the slant portion of the decompression passage 20 and as detailed in FIG. 3, it includes a valve support 28 screwed in the cylinder 12 and having a conical seat, a spool 26 having a conical valve which abuts on the conical seat to close the decompression passage 20, and a coil spring 27 compressedly interposed between the spool 26 and valve support 28, the spool 26 being normally urged by the coil spring 27 to close the decompression passage 20.

As will be best seen by making reference to FIGS. 2 and 3, the valve operating means 50 includes an engaging rotary member 51 formed of a round rod and bent to take the form of a crank shape and a rotary push member 52 operative to push the decompression valve 25. The engaging rotary member 51 is formed, at its outer end (upper portion) **51*b*, with a fit-in connection 53 which has a cross-sectional form of a race track or a kobang and which is threaded, on its curved surfaces, with a male screw 54 so that the engaging rotary member 51 may bear on the bearing plate 36, with the male screw 54 projecting upwards from the bearing plate 36 and with a portion of the outer end 51*b* lower than the male screw 54 inserted in the insertion hole 37. The root (bottom portion) 51*a* of the engaging rotary member 51 is loosely fitted in the circumferential groove 61 of the rotation transmission member 60 through the engaging hole 72 formed in the inverted U-shaped engaging part 73 of the aforementioned friction braking member 70**.

On the other hand, the rotary push member 52 includes a flat base seat **52*a* seated on the bearing plate 36 provided on the starter cover 31 and having a race track or kobang shaped engaging hole 55 through which the male screw 54 of the engaging rotary member 51 passes to cause the fit-in connection 53 to be fitted in the engaging hole 55, an upright plate 52*b* bent uprightly contiguously from the base seat 52*a* and formed with a reinforcement rib, and a pusher 52*c* curvedly contiguous to an upper portion of the upright plate 52*b*** to project transversely therefrom.

While the fit-in connection 53 of the engaging rotary member 51 is passed through the insertion hole 37 of the starter cover 31 and the engaging hole 55 of the rotary push member 52 to project beyond the base seat **52*a*, the engaging rotary member 51 and the rotary push member 52 are coupled together by tightening, through washers 58, a nut 57 screwed on the male screw 54 of the fit-in connection 53 and under this condition, they are allowed to rotate altogether. Positions and dimensions of individual components are set in such a manner that when the rotary push member 52 is rotated about a pivotal shaft realized with the fit-in connection 53 of the engaging rotation member 51, it can push a tip end (operating end) 26*a* of the spool 26 of the decompression valve 25**.

Operation/Function/Effects

Figure 4:
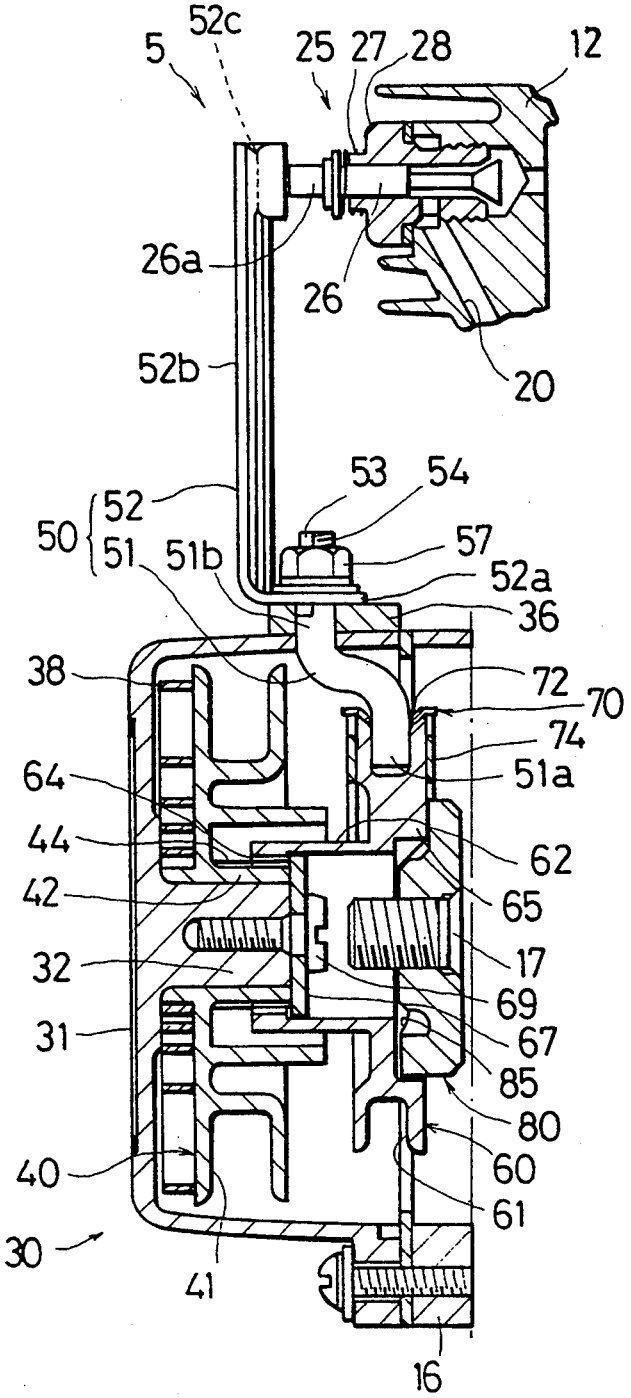
FIG. 4 is an enlarged longitudinal sectional view useful to explain operation of the main part of the embodiment.
Figure 5:
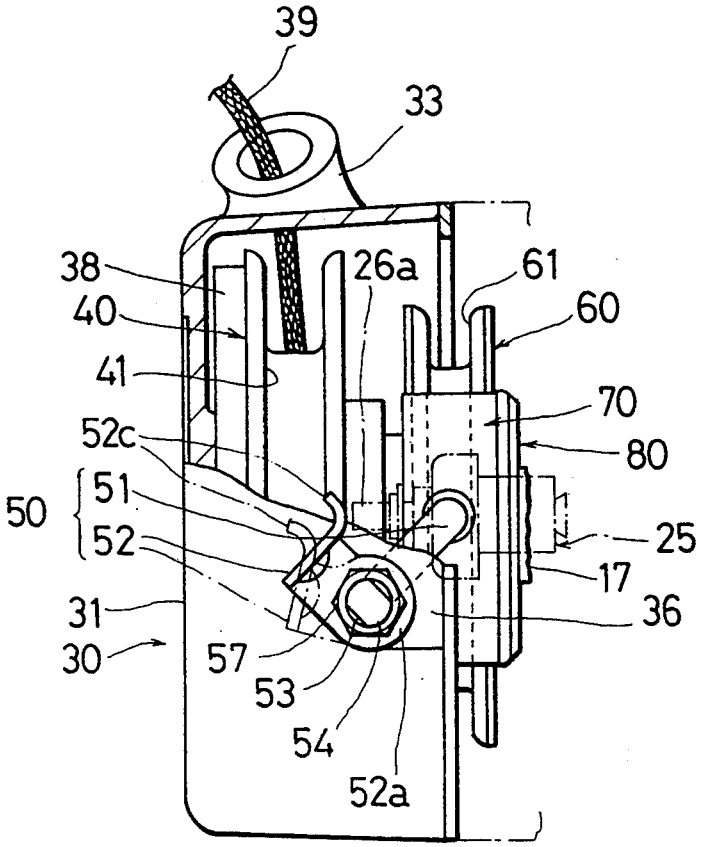
FIG. 5 is a plan view, parly cut away, useful to explain operation of the main part of the embodiment.

FIGS. 3, 4 and 5

With the construction described previously, when the handle 34 is pulled out to rushingly pay out the recoil rope 39 from the starter cover 31 for the purpose of start-up of the engine, the recoil drum 40 is rotated to produce torque which in turn is transmitted to the rotation transmission member 60 through the male spiral spline teeth 44 and the female spiral spline teeth 64. At that time, due to the fact that co-rotation of the rotation transmission member 60 along with the recoil drum 40 is regulated by means of the friction braking member 70, a circumferential component of force acting on the spiral spline teeth 44 and 64 is absorbed by friction occurring between the rotation transmission member 60 and the friction braking member 70 and as a consequence the rotation transmission member 60 is moved by a remaining axial component of force in the axial direction to approach the crank shaft 17. More specifically, in that case, the friction braking member 70 is about to rotate in synchronism with rotation of the rotation transmission member 60 but in effect the inverted U-shaped engaging portion 73 of the friction braking member 70 engages the root **51*a* of the engaging rotary member 51 of the valve operating means 50 to prevent co-rotation of the friction braking member 70 along with the rotation transmission member 60, with the result that the friction braking member 70 is moved along with the rotation transmission member 60 in the axial direction while the clamping friction plate parts 74 of the friction braking member 70 slidably contacting the both sides of the rotation transmission member 60**.

As the rotation transmission member 60 moves in the axial direction, the engaging rotary member 51 is drawn toward the crank shaft 17 by means of the circumferential groove 61 of the rotation transmission member 60 in which the root **51*a* of the engaging rotary member 51 is inserted and consequently the engaging rotary member 51 bearing on the bearing plate 36 is rotated by a predetermined rotation angle corresponding to a moving distance of the rotation transmission member 60. At that time, the clamping friction plate 74 is slightly slidden on the rotation transmission member 60 in the circumferential direction to allow the rotation of the engaging rotary member 51**.

When the rotation transmission member 60 is moved in the axial direction as described above, the drive pawls 65 formed on the side close to the crank shaft 17 engage the follower pawls 85 of the follower pawl member 80, whereby torque of the recoil drum 40 is transmitted to the crank shaft 17 through the rotation transmission member 60 and the follower pawl member 80, so that the recoil drum 40, the rotation transmission member 60 and the crank shaft 17 are rotated altogehter to perform cranking operation by means of the recoil starter 30.

In this procedure, the engaging rotary member 51 and the rotary push member 52 are rotated altogether and as will be best seen by making reference to FIG. 5 in addition to FIG. 4, the pusher 52*c* of the rotary push member 52 pushes the spool 26 of the decompression valve 25 to open the decompression valve 25. Through this, the air-fuel mixture in the combustion chamber 15 is admitted to the scavenging port 22 through the decompression passage 20 to reduce pressure acting on the top surface of the piston 14. As a result, torque required to rotate the crank shaft 17 is decreased, thereby making it possible to start the engine easily without applying so large an operating force to the recoil starter 30.

When the cranking operation is carried out to apply a certain rotation speed to the crank shaft 17 as described previously, the pay-out of the recoil rope 39 ends and the handle 34 is released, whereby conversely to the cranking operation, the recoil drum 40 is rotated in the direction in which the recoil rope 39 is rolled up by the action of the spiral spring 38 which has been rolled up to be compressed during the cranking operation and concurrently therewith, the rotation transmission member 60 recovers its original position to thereby ensure that the valve operating means 50 is also rotated to recover its original position so as to close the decompression valve 25; but the crank shaft 17 continues to make a certain number of rotations under the influence of inertial force of the flywheel 21 while the engine being started to acquire rotation by itself.

As described above, since the decompression device 5 of the present embodiment is so constructed that the valve operating means 50 bears on the bearing plate 36 provided in the starter cover 31 and is rotated by utilizing the axial movement of the rotation transmission member 60 of the recoil starter 30, it suffices that the engaging rotary member 51 of the valve operating means 50 is passed through the insertion hole 37 for bearing formed in the starter cover 31 and there is no need of forming a large opening as in the prior art which can allow lateral movement of valve operating means. In this case, when the outer end 51*b* of the engaging rotary member 51 bears on the insertion hole 37 for bearing formed in the starter cover 31, the insertion hole 37 is sealed airtightly.

Under this condition, intrusion of foreign matter such as dusts and dirts or powder material, pest control liquid or cut grasses into the starter cover 31 and its clogging in the openning can be prevented steadily to effectively avoid such a trouble that operation of such sliding parts as the recoil drum 40 and the rotation transmission member 60 arranged in the starter cover 31 or operation of the valve operating means 50 becomes defective.

Further, since the valve operating means 50 can be constructed separately from the friction braking member 70 of the recoil starter 30 and in addition it can operate the decompression valve 25 by its rotary motion, the valve operating means 50 is hardly flexed and bent when it operates the decompression valve 25. In particular, by using such a member as the rotary push member 52 which has a width in a direction along the pushing direction of the spool 26 of decompression valve 25, steady opening of the decompression valve 25 can be ensured. In this manner, with the relatively simplified construction, defective operation of the decompression device hardly occurs and reliability of the decompression device can be improved.

While in the foregoing embodiment the root 51*a* of the engaging rotary member 51 is loosely fitted in the circumferential groove 61 of the rotation transmission member 60, the root 51*a* may otherwise be pressed slightly on the circumferential groove 61, whereby the root 51*a* can act as a friction braking member and therefore the friction braking member 70 can be omitted. In this case, it is recommended that a press member having appreciable resiliency be additionally provided to the root 51*a* and/or the circumferential groove 61.

In the foregoing embodiment, the valve operating means 50 is comprised of the two members, that is, the engaging rotary member 51 and rotary push member 52 but obviously it may be constructed of a single member.

As will be seen from the foregoing, according to the decompression device of engine of the present invention, the valve operating means bears on the starter cover and is rotated by utilizing the axial movement of the rotation transmission member of the recoil starter and therefore, with the valve operating means passed through the insertion hole for bearing formed in the starter cover, there is no need of forming a large opening as in the prior art which is adapted to permit lateral motion of the valve operating means in the axial direction.

As a consequence, intrusion of such foreign matter as dusts and dirts or powder materials, pest control liquid or cut grasses into the starter cover and its clogging in the opening can be prevented steadily to effectively avoid such a trouble that operation of the rotary sliding parts such as the recoil drum and the rotation transmission member arranged in the starter cover or operation of the valve operating means becomes defective.

In addition, since the valve operating means can be constructed separately from the friction braking member of the recoil starter and the decompression valve can be rotated by rotary motion of the valve operating means, undesired flection and bending of the valve operating member upon operation of the decompression valve can be avoided, so that with the relatively simplified construction, defective operation hardly occurs to improve reliability of the device to advantage.

What is claimed is:

1. A decompression device for an internal combustion engine with a recoil starter having a starter cover, a recoil drum housed in said recoil starter cover, and a rotation transmission member movable axially of said recoil drum to transmit torque from said recoil drum to a crank shaft of said engine, said decompression device comprising:

a decompression passage through which a combustion chamber defined by the inner wall surface of a cylinder and the top surface of a piston in an engine body communicates with the outside upon start-up operation;

a decompression valve in said decompression passage; and valve operating means supported by a dust sealing bearing extending through said starter cover, thereby maintaining the dust protecting function of the starter cover, and rotated upon axial movement of said rotation transmission member to operate said decompression valve.

2. A decompression device for an internal combustion engine with a recoil starter having a starter cover, a recoil drum housed in said recoil starter cover, and a rotation transmission member movable axially of said recoil drum to transmit torque from said recoil drum to a crank shaft of said engine, said decompression device comprising:

a decompression passage through which a combustion chamber defined by the inner wall surface of a cylinder and the top surface of a piston in an engine body communicates with the outside upon start-up operation;

a decompression valve in said decompression passage; and valve operating means supported by a bearing in said starter cover and rotated upon axial movement of said rotation transmission member to operate said decompression valve;

said valve operating means including an engaging rotary member bent to take the form of a crank and having its root engaging said rotation transmission member and its outer end in said bearing provided in said starter cover, and a rotary push member fitted on said outer end of said engaging rotary member and rotatable with said engaging rotary member to push an operating end of said decompression valve.

* * * * *